US012264489B1

(12) United States Patent
Langkamp et al.

(10) Patent No.: US 12,264,489 B1
(45) Date of Patent: Apr. 1, 2025

(54) ENVIRONMENTALLY FRIENDLY REUSABLE STRUCTURE FOR USE IN CONSTRUCTION

(71) Applicant: Providencia Composites, LLC, Chattanooga, TN (US)

(72) Inventors: James Langkamp, West Chicago, IL (US); Robert Langkamp, Wheaton, IL (US); Michael Elliott, Elgin, IL (US)

(73) Assignee: Providencia Composites, LLC, Chattanooga, TN (US)

( * ) Notice: Subject to any disclaimer, the term of this patent is extended or adjusted under 35 U.S.C. 154(b) by 0 days.

(21) Appl. No.: 18/737,941

(22) Filed: Jun. 7, 2024

(51) Int. Cl.

| | |
|---|---|
| ***E04G 9/05*** | (2006.01) |
| ***E04G 9/06*** | (2006.01) |
| ***E04G 17/02*** | (2006.01) |
| ***E04G 17/04*** | (2006.01) |

(52) U.S. Cl.
CPC ..... *E04G 9/05* (2013.01); *E04G 9/06* (2013.01); *E04G 17/02* (2013.01); *E04G 17/04* (2013.01)

(58) Field of Classification Search
CPC .. E04G 9/02; E04G 9/05; E04G 17/02; E04C 2/36
See application file for complete search history.

(56) References Cited

U.S. PATENT DOCUMENTS 3,732,138 A * 5/1973 Almog ..... E04C 2/205 428/416
4,181,286 A 1/1980 Van Doren
4,307,140 A * 12/1981 Davis ..... B32B 13/12 428/44
4,567,710 A 2/1986 Reed
(Continued)

FOREIGN PATENT DOCUMENTS

EP 2540933 A1 * 1/2013 ..... E04G 9/05
EP 2462296 B1 5/2014
WO WO-2015/199530 A1 12/2015

OTHER PUBLICATIONS

Precise Forms, Inc., "Modular Aluminum Forms" (2024). Retrieved from Internet on Mar. 10, 2024: URL: https://preciseforms.com/modular-aluminum-forms/.

(Continued)

*Primary Examiner* — Christine T Cajilig
(74) *Attorney, Agent, or Firm* — MARSHALL, GERSTEIN & BORUN LLP

(57) ABSTRACT

A reusable modular structural member may replace wooden structures used in concrete forming, transportation, marine, and construction applications. The reusable modular structural member includes a structural profile with first and second sides; a plurality of support beams extending from the first to the second side; at least two fasteners, one at a first end and another at a second end of each of the plurality of ribs; and a groove on a first edge and a tongue on a second edge that are configured to form a dovetail joint that can attach two reusable modular structural members of similar configuration. A reusable modular member can include the modular structural profile and interfacial layers covering the first and second sides. The reusable modular member may be made by extruding the structural profile and molding a recycled plastic polymer to external portions of the structural profile to form the interfacial layers.

20 Claims, 16 Drawing Sheets

(56) References Cited

U.S. PATENT DOCUMENTS

| | | | | |
|---|---|---|---|---|
| 5,190,803 | A * | 3/1993 | Goldbach | B62D 29/004 264/261 |
| 5,535,565 | A * | 7/1996 | Majnaric | E04C 3/36 52/425 |
| 5,547,737 | A * | 8/1996 | Evans | B32B 3/20 428/188 |
| 5,585,155 | A | 12/1996 | Heikkila et al. | |
| 5,792,552 | A * | 8/1998 | Langkamp | B32B 3/28 249/176 |
| 6,357,197 | B1 | 3/2002 | Serino et al. | |
| 7,721,496 | B2 * | 5/2010 | Carlson | B29C 44/06 52/843 |
| 7,837,174 | B2 | 11/2010 | McNamara | |
| 8,065,848 | B2 * | 11/2011 | Carlson | B32B 5/18 52/843 |
| 8,567,750 | B2 | 10/2013 | Amend | |
| 8,967,588 | B2 | 3/2015 | Sladojevic et al. | |
| 10,364,570 | B2 * | 7/2019 | Johnston | E04G 11/06 |
| 10,890,001 | B2 | 1/2021 | Hollmann | |
| 11,391,032 | B1 | 7/2022 | Van Doren | |
| 2007/0062146 | A1 * | 3/2007 | Van Dijk | E04C 2/22 52/580 |
| 2007/0200050 | A1 * | 8/2007 | Kanao | E04G 9/05 249/33 |
| 2013/0008104 | A1 | 1/2013 | Caboni | |
| 2020/0018081 | A1 * | 1/2020 | Amato | E04G 13/00 |
| 2020/0139652 | A1 * | 5/2020 | Collar | B29C 48/00 |

OTHER PUBLICATIONS

Deco-Crete Supply, "Plastiform" (2024). Retrieved from Internet on Mar. 10, 2024: URL: https://www.deco-cretesupply.com/products/forms-expansion-wire/plastiform.

David W. Johnston, P.E., Ph.D., "Design and Construction of Concrete Framework" Concrete Construction Engineering Handbook, Chaper 7 (2008).

* cited by examiner

ENVIRONMENTALLY FRIENDLY REUSABLE STRUCTURE FOR USE IN CONSTRUCTION

FIELD OF THE DISCLOSURE

The present disclosure relates to reusable structures which may be used as a substitute for plywood and other materials used in construction or fabrication of items. The reusable structure finds particular use in forming concrete structures such as walls, floors, support columns, slabs, reinforced concrete beams, and the like.

BACKGROUND

Concrete structures are conventionally made with energy and resource intensive processes. From the creation of the constituents of concrete, such as cementitious materials and aggregate, to the casting and curing of concrete, there are many opportunities to reduce the carbon footprint of a concrete structure.

In forming a concrete structure, wooden panels traditionally help shape poured concrete and surround the concrete until the structure is cured. Such structures are erected one section at a time, and the wooden panels may be used to form another portion of the structure. Wooden panels, while currently relatively light-weight and moderately priced, require supporting frames, a form releasing agent (e.g., oil and an oiling procedure) to prevent adhesion of the wooden panels to the concrete, and will eventually degrade and become unusable over time. The wooden materials, with relatively short lifetimes under the harsh environment of setting concrete, also lead to the undesirable consumption of a large number of trees.

In order to extend the useful life of wooden panels for concrete forming, plastic coatings have been applied to the panels with some success, but such coatings undesirably increase the weight of the forms and panels. Coated wooden boards also suffer from delamination at the interface of the wood and plastic due to the alkaline nature of concrete lime, particularly at points where nails or other fixtures have been inserted to connect to a supporting frame.

SUMMARY OF THE DISCLOSURE

In accordance with a first aspect, a reusable structural member is provided. The reusable structural member includes a structural profile with a length, a width, and a thickness, as well as a first side and a second side opposite the first side in which the first and second sides define the width and the length. The reusable structural profile also includes a first edge and a second edge opposite the first edge. The first edge and the second edge extend between the first and second sides define the thickness. The reusable structural profile also has a plurality of support beams, each support beam extending between the first side and the second side. A fastener is disposed at a first end of each of the plurality of support beams of the reusable structural profile. The reusable structural member further includes an interfacial layer and a groove disposed along the first edge and a tongue disposed along the second edge of the structural profile. In the structural member, the tongue is configured to be disposed in a groove of a second reusable structural profile to join the reusable structural profile and the second reusable structural profile together. The groove of the structural member is configured to receive a tongue of a third reusable structural profile to join the reusable structural profile and the third reusable structural profile together, in which the fasteners help secure the interfacial layer to the structural profile, and in which at least one of the support beams and the interfacial layer comprises recycled material.

In further accordance with the first aspect, the interfacial layer may be configured to contact concrete while concrete is poured and sets. The interfacial layer may be resistant to alkaline pH conditions, elevated temperatures, water or other liquid absorption, and abrasion by any of sand and aggregate.

In some forms, the recycled material may include recycled plastic. The recycled plastic may include any of the following: PP (polypropylene), PTFE (polytetrafluoroethylene), PEEK (polyether ether ketone), PEI (polyetherimide), PAI (polyamide-imide), PBI (polybenzimidazole), PET (polyethylene terephthalate), PVC (polyvinylchloride), and any combination thereof. In such forms, the interfacial layer may further include a layer of composite material that includes a recycled polymer, a recycled glass component, or both a recycled polymer and a recycled glass component.

In further accordance with the first aspect, the structural member also includes one or more open volumes, in which each of the one or more open volumes is bounded by the first side or the second side, and at least one of the plurality of support beams. The structural member also includes a filler disposed in the one or more open volumes in which the filler includes any of the following: a foamed material, a hexagonal cell material, a corrugated cardboard, and a sprayed-in expanding material.

In accordance with a second aspect, an extruded structural profile for casting concrete is provided. The extruded structural profile includes a length, a width, and a thickness, and a first side and a second side that is opposite the first side. The first and second sides define the width and the length of the extruded structural profile. The extruded structural profile also includes a first edge and a second edge that is opposite the first edge, in which each of the first and second edges extend between the first and second sides and define the thickness. A plurality of support beams are also part of the extruded structural profile, and each support beam extends between the first side and the second side. The extruded structural profile also includes a fastener disposed at a first end of each of the plurality of support beams. The fastener is adapted to help secure an interfacial layer to the extruded structural profile. A groove that is disposed along the first edge is part of the extruded structural profile, as well as a tongue that is disposed along the second edge. The tongue is configured to be disposed in a groove of a second extruded structural profile to join the extruded structural profile and the second extruded structural profile together. The groove is configured to receive a tongue of a third extruded structural profile to join the extruded structural profile and the third extruded structural profile together.

In further accordance with the second aspect, the extruded structural profile is formed of a recycled metal. In some such extruded structural profiles, the recycled metal is recycled aluminum.

Further, in accordance with the second aspect, each of the fasteners is a female fastener that includes a recess into a corresponding support beam of the plurality of support beams in the extruded structural profile. Each female fastener may include a narrowed neck at an opening of the respective recess.

Alternatively, in accordance with the second aspect, each fastener of the extruded structural profile includes a protrusion extending from a corresponding support beam of the plurality of support beams, in which the protrusion extends beyond the first or second side of the structural profile.

In accordance with a third aspect, a method for making a reusable modular structural member for casing concrete is provided. The method includes forming first and second structural profiles. Each structural profile has a length, a width, and a thickness. The structural profile also has a first side and a second side which is opposite the first side, and the first and second sides define the width and the length of the structural profile. Each structural profile includes a first edge and a second edge that is opposite to the first edge. Each of the first and second edges extend between the first and second sides, as well as define the thickness of the structural profile. Each structural profile also includes a plurality of support beams, and a fastener disposed at a first end of each of the plurality of support beams. A groove that is disposed along the first edge and a tongue that is disposed along the second edge of the reusable structural member are also part of each structural profile. Each support beam extends between the first side and the second side. The method also includes connecting the first and second structural profiles by disposing the tongue of the first structural profile in the groove of the second structural profile, forming a connected structure in this way. The method further includes applying an interfacial layer on the connected structure, in which at least one of the support beams and the interfacial layer includes recycled material.

In further accordance with the third aspect, forming the first and second structural members includes extruding the first and second structural members using aluminum. In such methods, applying the interfacial layer of recycled material may include molding a polymer material to external portions of the connected structure.

In accordance with the third aspect, the method includes flowing the polymer material into a fastener, in which the fastener includes a recess in a corresponding support beam of the plurality of support beams or a protrusion extending from a corresponding support beam of the plurality of support beams away from the middle portion of the connected structure.

Further in accordance with the third aspect, the method further includes inserting a filler into one or more open volumes in the structural member in which the one or more open volumes is each bounded by the first side and the second side of the first or second structural profile and at least one of the plurality of support beams. The filler includes any of the following: a foamed material, a hexagonal cell material, a corrugated cardboard, and a sprayed-in expanding material.

In accordance with a fourth aspect, a system for shaping a cast concrete structure is provided. The system includes a first reusable structural member in accordance with the first aspect and a second reusable structural member having a similar configuration to that of the first reusable structural profile. The first reusable structural member and the second reusable structural member are removably jointed along edges having grooves and tongues, such that the joined edges form a dove tail joint.

In further accordance with the fourth aspect, the system further includes fittings which secure a third reusable panel in a fixed position relative to the first and second reusable panels.

BRIEF DESCRIPTION OF THE DRAWINGS

The Figures described below depict various aspects of the apparatus, systems, and methods disclosed therein. It should be understood that each figure depicts an example of a particular aspect of the disclosed apparatus, systems, and methods, and that each of the figures is intended to accord with a possible example thereof. Further, wherever possible, the following description refers to the reference numerals included in the following figures, in which features depicted in multiple figures are designated with consistent reference numerals.

There are shown in the drawing arrangements which are presently discussed, it being understood, however, that the present examples are not limited to the precise arrangements and instrumentalities shown, wherein.

DETAILED DESCRIPTION

Figure 1:
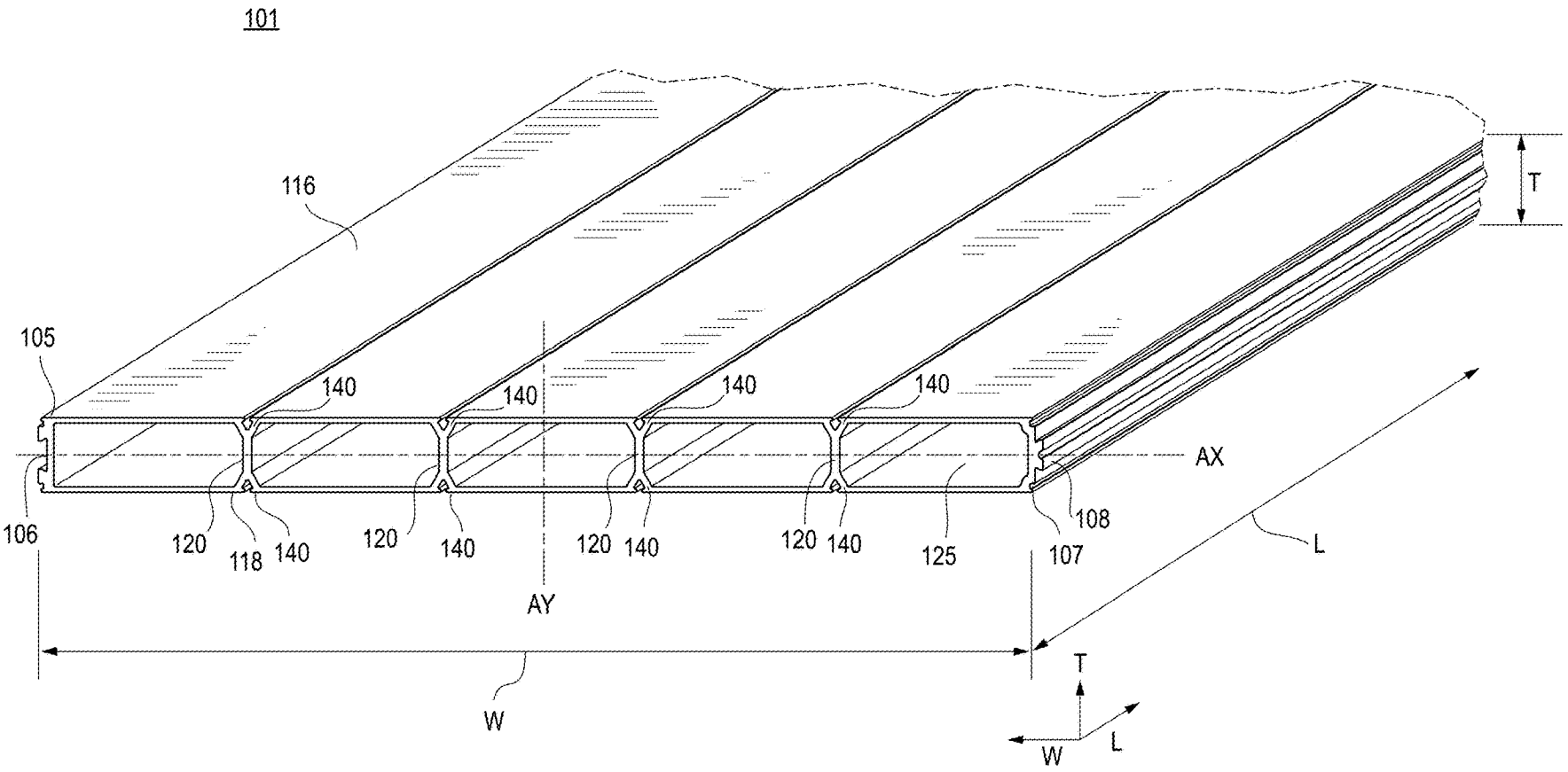
FIG. 1 is a perspective view of one example of a structural profile, in accordance with the present disclosure.

The present disclosure is directed to a durable, modular, reusable (i.e., multi-use) structural member that aims to enable the creation of concrete structures in a way that has a lower carbon-foot print and is less toxic than conventional concrete casting forms (e.g., forms made partially or entirely of plywood). The reusable nature of the structural profiles described herein reduces the amount of lumber required to make these conventional concrete casting forms. At the same time, the materials, structure, and fabrication method of the structural member prevent delamination of the layers of the members that contact poured concrete, reduce the need for a releasing agent for the cured concrete, and create lightweight but strong structures that can easily be customized into various casting forms.

Turning to the Figures, FIGS. 1-7E illustrate an example of a structural profile 101 that is constructed in accordance with the teachings of the present disclosure and, as such, can be used for casting concrete. The structural profile 101 has a first edge 105, a second edge 107 that is opposite the first edge 105, a first side 116, a second side 118 that is opposite the first side 116, a plurality of support beams 120, and a plurality of fasteners 140. The structural profile 101 is generally rectangular in shape and has a length L, a width W, and a thickness T, with the width W being much greater than the thickness T. The first side 116 and second side 118 define the width W and the length L of the structural profile 101. The first edge 105 and the second edge 107 define the thickness T of the structural profile 101. The structural profile 101 is substantially symmetric about a horizontal axis AX located at a horizontal midline of the structural profile 101. The structural profile 101 also includes a groove 106 on the first edge 105 and a tongue 108 on the second edge 107 that can be used to join the structural profile 101 to an adjacent structural profile, as will be discussed in greater detail below. With the exception of the groove 106 on the first edge 105 and the tongue 108 on the second edge 107, the structural profile 101 is also substantially symmetric about a vertical axis AY located at a vertical midline of the structural profile 101.

The support beams 120 are generally configured to support the first and second sides 116, 118 during use (e.g., when used to cast concrete). Each of the support beams 120 run from the first side 116 to the second side 118 (and vice-versa). Each support beam 120 has a first end 121 that is immediately adjacent the first side 116 of the structural profile 101, and, correspondingly, a second end 122 of the support beam 120 that is immediately adjacent to the second side 118. In this example, the structural profile 101 includes four support beams 120 equally spaced apart from one another along the width W of the structural profile 101. In other examples, the structural profile 101 can include more or less support beams 120 and/or the support beams 120 can be spaced apart from one another in a different manner.

Figure 2:
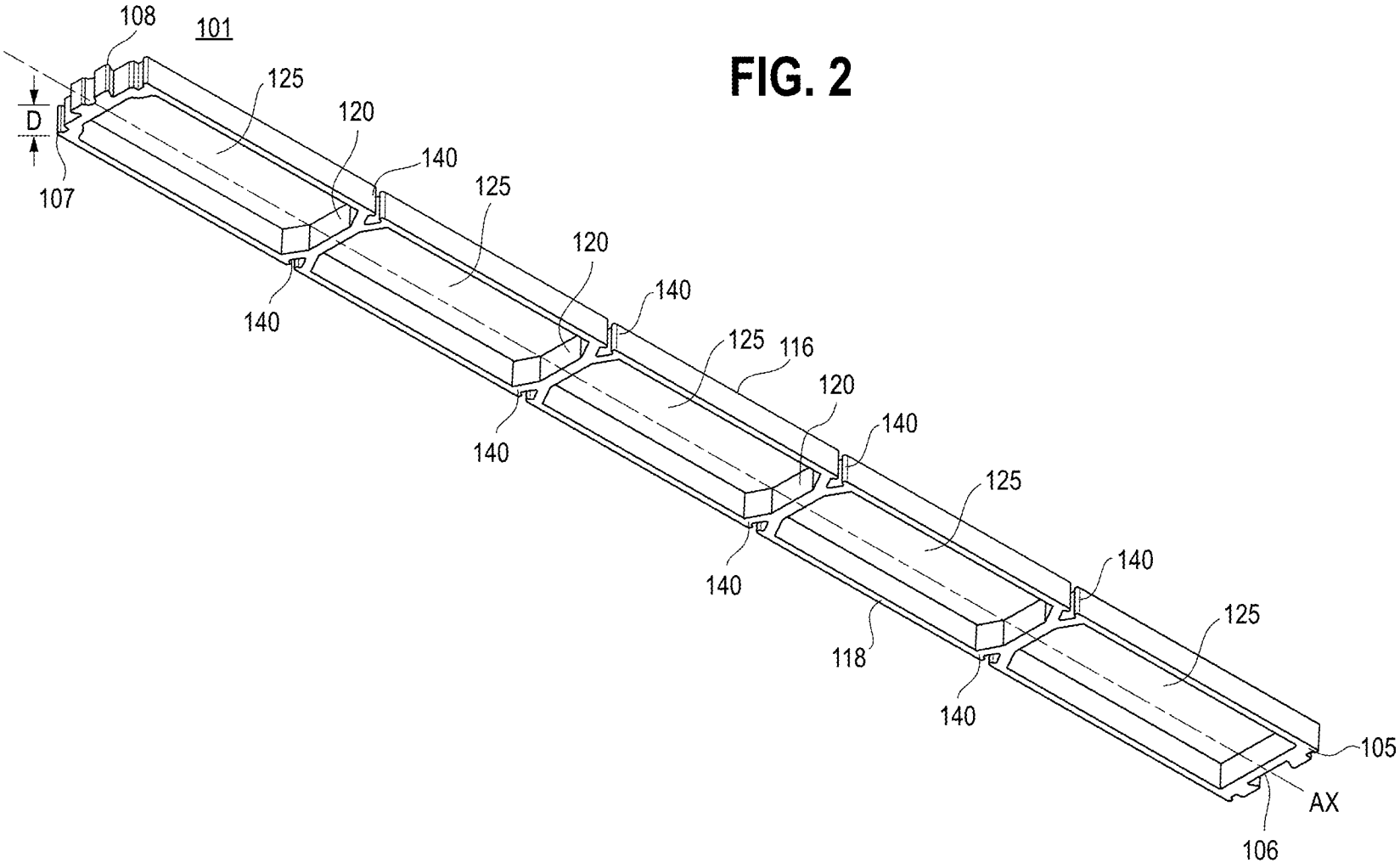
FIG. 2 is another perspective view of the structural profile, in accordance with the example shown in FIG. 1.
Figure 3:
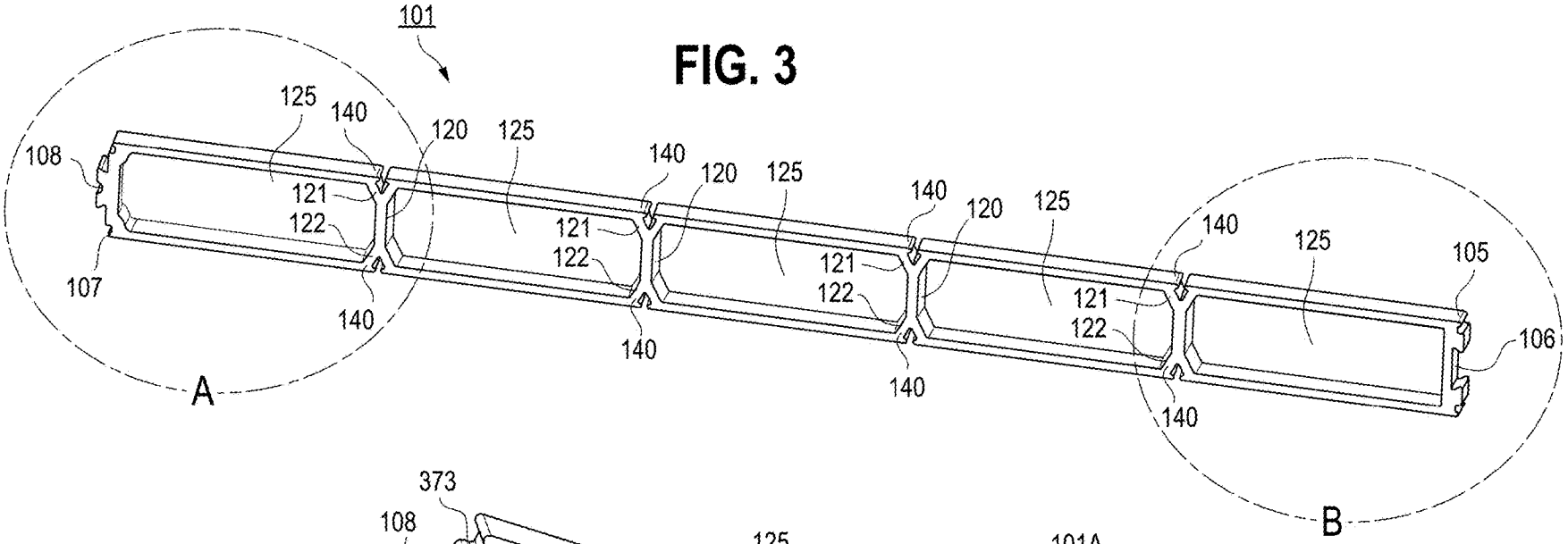
FIG. 3 is a further perspective view of the structural profile, in accordance with the example shown in FIG. 1.

The fasteners 140 are disposed along the first and second sides 116, 118 of the structural profile 101 and are generally configured to facilitate the attachment of an interfacial layer (e.g., interfacial sheet 150A or 150B shown in FIG. 11A, FIG. 11B) to the structural profile 101. That is to say, the fasteners 140 are adapted to secure an interfacial layer to a structural profile 101. For example, the fasteners 140 can have features that help guide a material associated with the interfacial layer to flow into and/or around each fastener 140. Each of the fasteners 140 of FIGS. 1, 2, and 3 is a female fastener with a recess 142. The recess 142 in this example has a substantially triangular shape, which may also be referred to as an arrowhead shape. In other examples, however, the recess 142 can have a different shape (e.g., a rectangular shape, an oval shape, or an irregular shape). Each fastener 140 also includes a narrowed neck 143 immediately adjacent to the respective recess 142. More particularly, the narrowed neck 143 is disposed at an opening of the respective recess 142 and is symmetric about a midline MR of the recess 142. The narrowed neck 143 is defined by rounded protrusions 144 from either the first or second side 116, 118 that extend into the area adjacent to the recess 142. The substantially triangular shape of each recess 142 is defined by an apex 145 and a base 146 across from the apex 145 and partially defined by the neck 143. Each apex 145 points to (i.e., is oriented toward) the midline of the structural profile 101, which is also the axis AX. The base 146 of each recess 140 is immediately adjacent to either the first side 116 or the second side 118 of the structural profile 101, depending upon whether that fastener 140 is disposed in the first side 116 or the second side 118. Because each of the recesses 142 in this example may resemble a regular triangle, the apex 145 of each recess 142 has an angle of approximately 60°.

In the example shown in FIGS. 1-7E, the structural profile 101 includes eight fasteners 140, four fasteners 140 disposed along the first side 116 and four fasteners 140 disposed along the second side 116 and opposite the other four fasteners. Each of the eight fasteners 140 is aligned with one of the support beams 120, such that the recesses 142 interface with a corresponding support beam 120. More particularly, the recesses 142 directly interface with the first end 121 or the second end 122 of the corresponding support beam 120. Moreover, each of the support beams 120 is disposed between two opposing fasteners 140. In other examples, however, the structural profile 101 can include more or less than eight fasteners 140 and/or the fasteners 140 can be arranged in a different manner.

Figure 4:
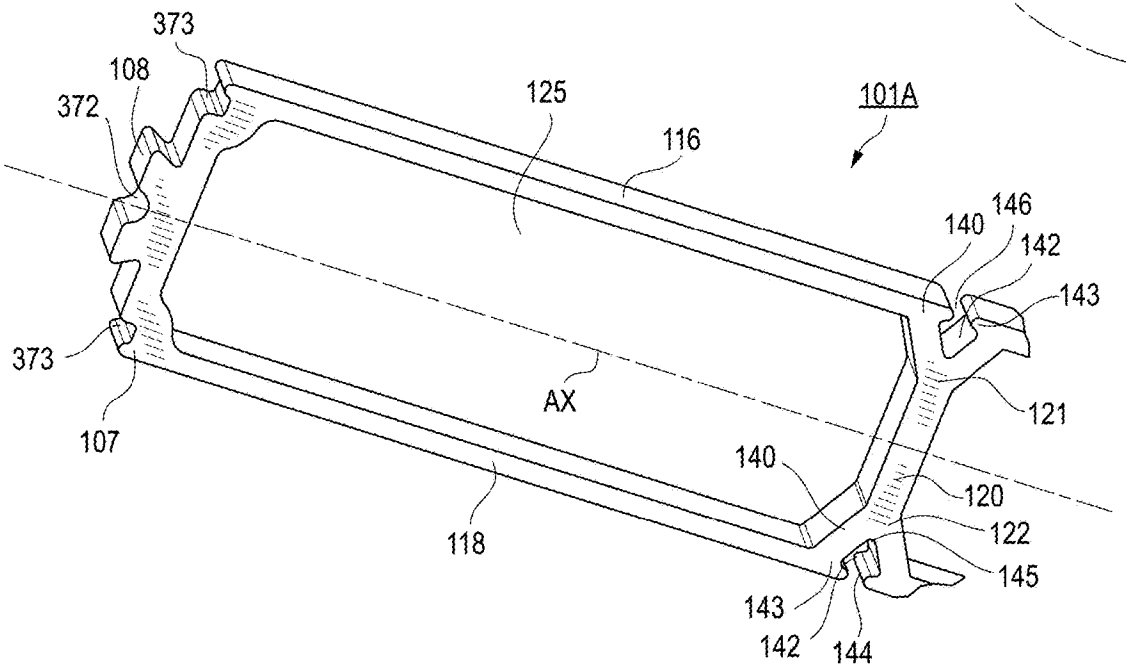
FIG. 4 is an enlarged perspective view of the portion of FIG. 3 encircled and labeled A, which shows a tongue of the structural profile.

FIG. 3 shows the first edge 105 and the groove 106 in circle B and the second edge 107 and the tongue 108 in circle A, and FIG. 4 is an enlarged view of a portion 101A of the structural profile 101 within circle A. As illustrated in FIG. 4, the tongue 108 extends outward from the second edge 107 such that the tongue 108 is configured to fit or slot into a groove 106 of an adjacent structural profile 101 to join the two structural profiles 101 together. The tongue 108 in this example extends outward from the second edge 107 along the horizontal axis AX, though the tongue 108 can extend outward from the second edge 107 along an axis that is parallel to or angled relative to the horizontal axis AX. The tongue 108 may include an oiling groove 372 at the center of the tongue 108. The oiling groove 372 may receive an oil or other fluid that serves as a lubricant for the dovetail joint created by the engagement between the joined tongue 108 and the groove 106 of the adjacent structural profile 101 when the two structural profiles 101 are joined together.

In addition to the tongue 108, the second edge 107 may have additional features 373 that help to join the two structural profiles 101 together and/or enhance the adhesion or bonding between the structural profile 101 and the interfacial layer attached thereto. These additional features 373 may be located symmetrically along the second edge 107, such that if the second edge 107 were rotated 180° about the axis AX, the location of the additional features 373 would appear unchanged. In some examples, an adhesive may be added to the tongue 108 or groove 106 to help join adjacent structural profiles 101 together. The adhesive may be glue, a pressure sensitive adhesive tape, an epoxy, or any other suitable means for enhancing the cohesion between two structural profiles 101. In some examples, the adhesive may be added to both the tongue 108 and groove 106 when joining adjacent structural profiles 101. Alternatively, in place of utilizing the tongue 108 and the groove 106 which form a dovetail joint to connect adjacent structural profiles 101, adhesive alone may be used to join the adjacent structural profiles 101 together.

Figure 5:
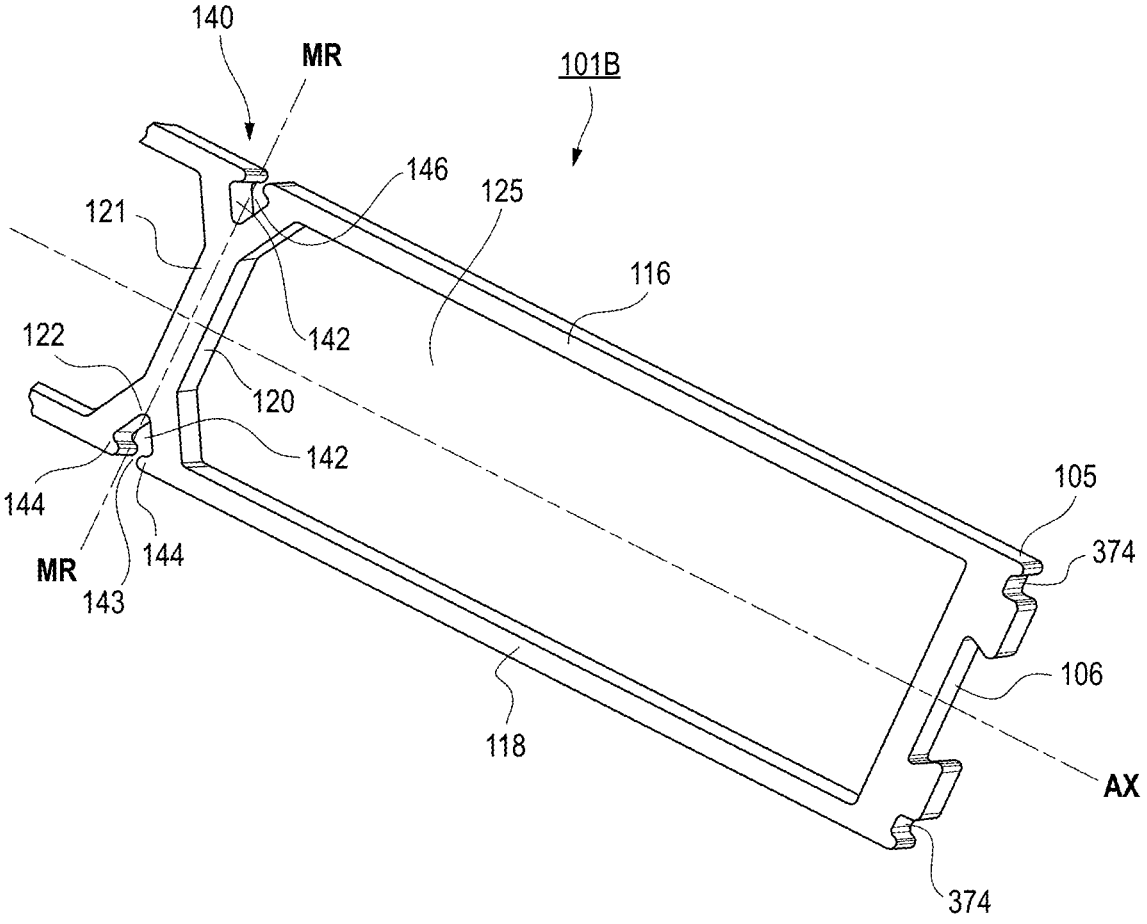
FIG. 5 is an enlarged perspective view of the portion of FIG. 3 encircled and labeled B which shows a groove of the structural profile.
Figure 6:
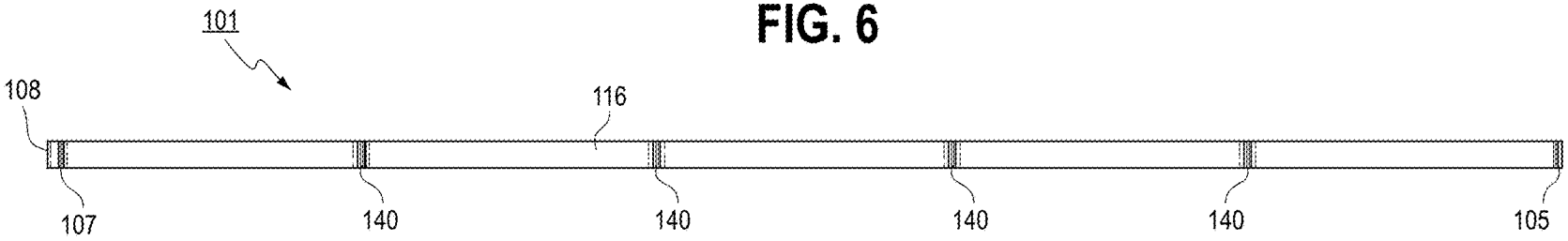
FIG. 6 shows a plan view of the structural profile, in accordance with the example shown in FIG. 1.
Figure 7A:
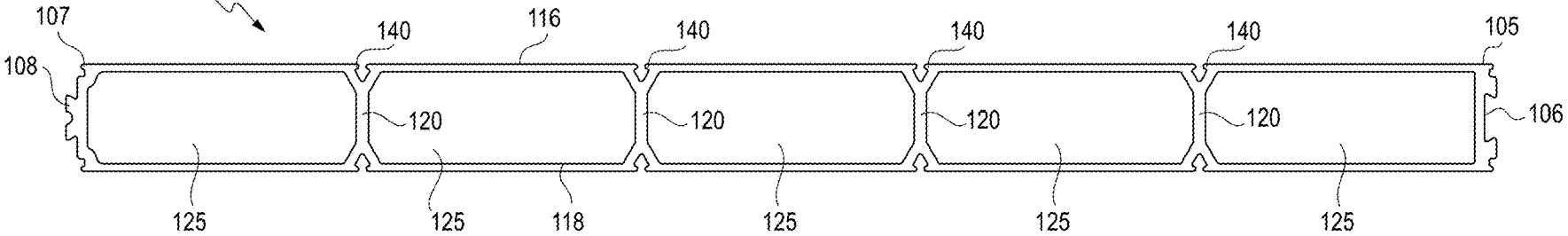
FIG. 7A shows a front elevation view of the structural profile, in accordance with the example shown in FIG. 1.
Figure 7B:
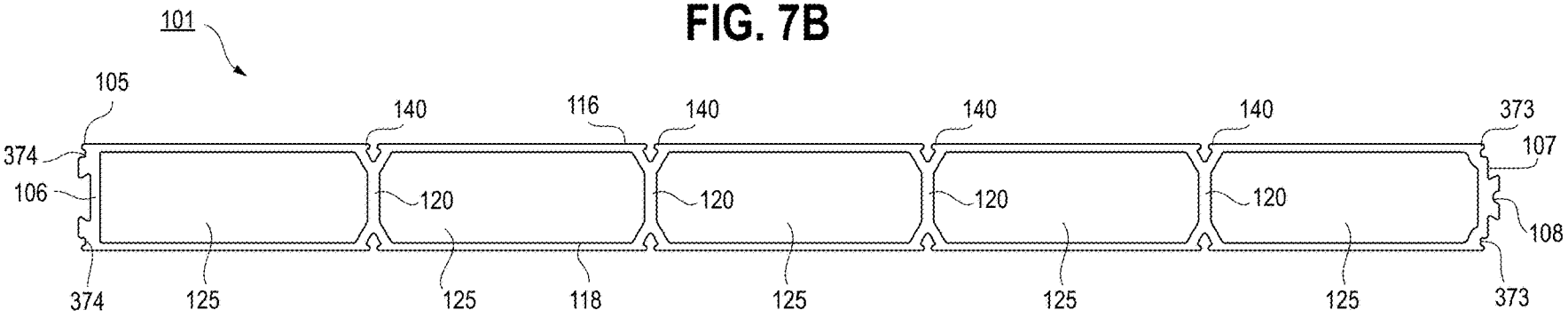
FIG. 7B shows a back elevation view of the structural profile, in accordance with the example shown in FIG. 1.
Figure 7D:
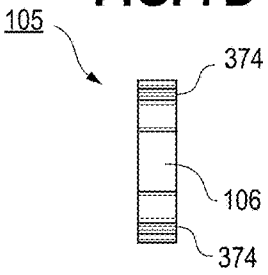
FIG. 7D shows a right side elevation view of the structural profile, in accordance with the example shown in FIG. 1.
Figure 7C:
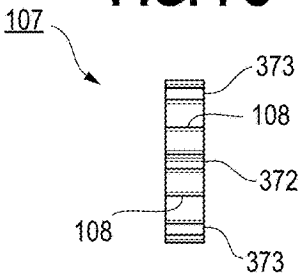
FIG. 7C shows a left side elevation view of a structural profile, in accordance with the example shown in FIG. 1.
Figure 7E:
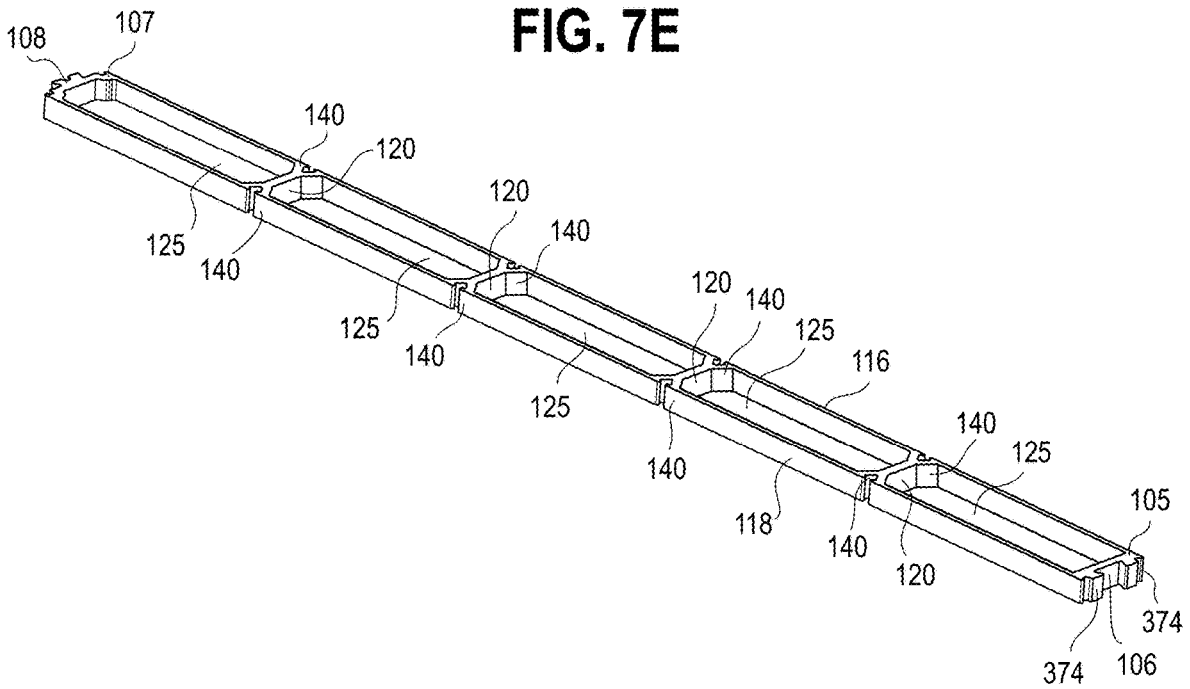
FIG. 7E shows a perspective view of the structural profile as seen from the right side, in accordance with the example shown in FIG. 1.

FIG. 5 is an enlarged view of a portion 101B of the structural profile 101 within the circle B of FIG. 3. As illustrated in FIG. 5, the groove 106 is formed in the first edge 105 such that the groove 106 is recessed relative to an outermost portion of the first edge 105. The groove 106 is thus configured to receive a tongue 108 of an adjacent structural profile 101 to join the two structural profiles 101 together. The groove 106 in this example is centered along the horizontal axis AX, though the groove 106 can be centered along a different axis that is parallel to or angled relative to the horizontal axis AX.

As with the second edge 107, the first edge 105 may have additional features 374 that help to join the two structural profiles 101 together and/or enhance adhesion between the structural profile 101 and the interfacial layer attached thereto. The additional features 374 may complement those additional features 373 on the second edge 107. In use, the additional features 374 may mate with the additional features 373 of the second edge 107. More particularly, when the two structural profiles 101 are joined together to form the dovetail joint, the additional features 374 engage with complementary additional features 373 so as to create a void into which material of the interfacial layer may flow, thus increasing or enhancing adhesion between the structural profile 101 and the interfacial layer. Like the additional features 373, the additional features 374 may be located symmetrically along the first edge 105 about the axis AX.

Turning back to FIGS. 1-3, the structural profile 101 includes a plurality of open volumes 125. Each open volume 125 is bounded, in part, by the first and second sides 116, 118 and at least one support beam 120. In some cases, the open volume 125 will be bounded by two support beams 120, while in other cases the open volume 125 will be bounded by one support beam 120 and the first edge 105 or the second edge 107. Each open volume 125 may be filled or remain open. In some cases, conduit, pipes, fittings, and the like, may be disposed in or routed through one or more of the open volumes 125 as needed during the concrete forming process. Alternatively, or additionally, a filler (not shown) may fill one or more of the open volume 125. The filler may be any of a natural material, a foamed material, a hexagonal cell material, a corrugated cardboard, a sprayed-in expanding material, and any other suitably light-weight material which increases the stiffness (e.g., resistance to compression and/or buckling) of the structural profile 101. The natural material may include any of balsa wood, cork, natural sponge, natural loofa, cotton, wool, and other light-weight, porous natural materials.

Figure 8:
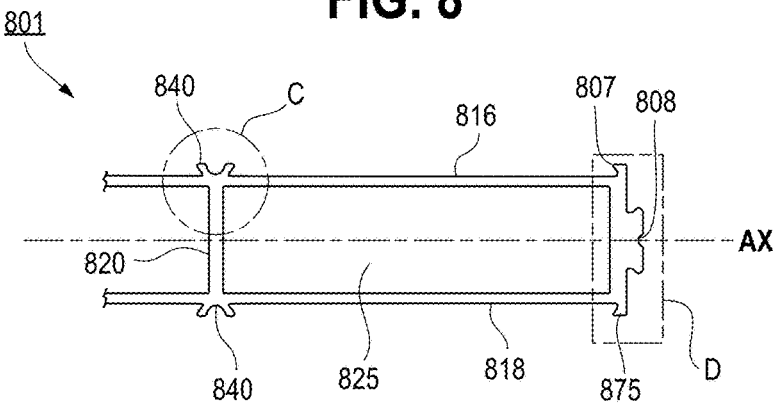
FIG. 8 is a front view of a portion of an example of a structural member constructed in accordance with the teachings of the present disclosure, the structural member with fasteners that include protrusions.
Figure 9:
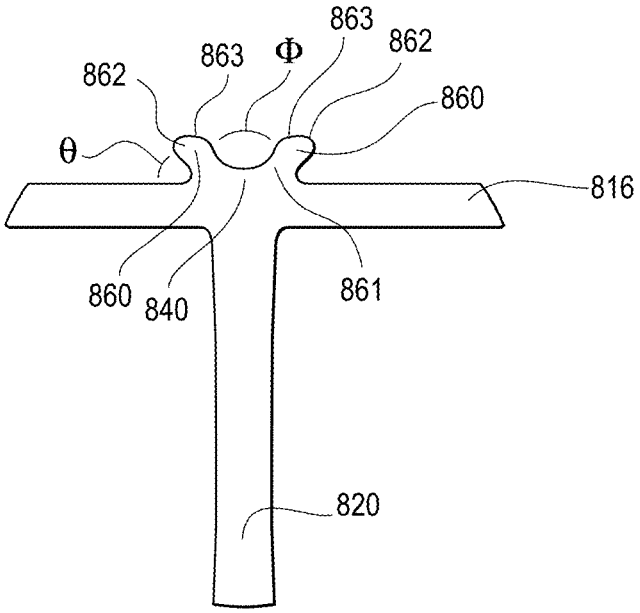
FIG. 9 shows an enlarged view of the encircled portion labeled C in the example shown in FIG. 8.
Figure 10:
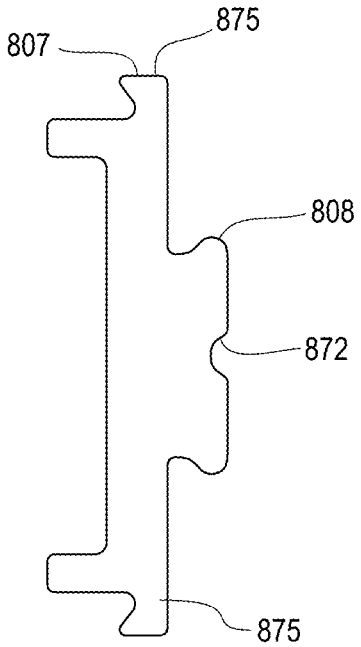
FIG. 10 shows an enlarged view of the encircled portion labeled D in the example shown in FIG. 8.

FIGS. 8-10 illustrate another example of a structural profile 801 that is constructed in accordance with the teachings of the present disclosure and, as such, can be used for casting concrete. The structural profile 801 is similar to the structural profile 101 in some ways, e.g., the structural profile 801 includes a first side 816, a second side 818, support beams 820, and open volumes 825. However, the structural profile 801 differs from the structural profile 101 in other ways. More particularly, the structural profile 801 includes fasteners 840 that differ from the fasteners 140, a tongue edge 807 (analogous to the second edge 107 of the structural profile 101), and a tongue 808 that is different from the tongue 108 of the structural profile 101. Moreover, while not illustrated in FIGS. 8-10, it will be appreciated that the structural profile 801 also includes a groove that is different from the groove 106 but is configured to receive the tongue 808 of an adjacent structural profile 801 to join the two structural profiles 801 together. In some examples, an adhesive (e.g., glue) may be added to the tongue 808 and/or the groove to help join adjacent structural profiles 801 together. Alternatively, in place of utilizing the tongue 808 and the groove to connect adjacent structural profiles 801, adhesive alone may be used to join the structural profiles 801 together.

Like the fasteners 140, the fasteners 840 are disposed along the first and second sides 816, 818 of the structural profile 801 and are generally configured to facilitate the attachment of an interfacial layer or sheet (e.g., interfacial layer 150A or 150B shown in FIG. 11A, FIG. 11B) to the structural profile 801. However, unlike the fasteners 140, each of the fasteners 840 is a protruding, or male, fastener with a pair of protrusions 860 which extend beyond the first side 816 or the second side 818 from a proximal end 861 to a distal end 862 (i.e., the end furthest away from the first side 816). As best shown in FIG. 9, the fasteners 840 in this example may be considered to resemble an anchor or a mammalian vertebrae. The protrusions 860 of these male fasteners 840 extend outward from the first side 816 at an angle θ. This angle θ may range from about 15° to 45°, such as from about 20° to 40°, including from about 25° to 30°. The protrusions 860 in each pair are separated by a second angle ϕ. This second angle ϕ may range from about 75° to 120°, such as from about 80° to 110°, including from about 85° to 105°. Each protrusion 860 is rounded at its distal end 862. However, there is a flattened end 863 to each protrusion 860 that, in part, defines the anchor shape of the protrusion 860. In use, the protrusions 860 may be surrounded by a portion of the material of the interfacial layer. Like a boat anchor has protrusions that dig into silt or sand beneath a vessel as it is dragged along a bay or harbor floor, preventing the vessel from drifting away with the current, the protrusions 860 may aid in keeping an adjacent interfacial layer from slipping or skewing while the combination of the structural profile 801 and interfacial layer are in use as part of a structural member.

As best illustrated in FIG. 10, the tongue 808 of the structural profile 801 extends outward from an outermost portion of the tongue edge 807 such that the tongue 808 is configured to fit or slot into a groove of an adjacent structural profile 801 to join the two structural profiles 801 together. The structural profile 801 also includes an oiling groove 872 and additional features 875 on the tongue edge 807. The additional features 875 on the tongue edge 807 are shown as protrusions from the edge 807 and may serve a similar role of facilitating attachment of the interfacial layer to the structural profile 801. The oiling groove 872, which is shown as being in the middle of the tongue 808, may serve a similar purpose as the oiling groove 372 of the structural profile 101, i.e., the oiling groove 872 provides a pathway for a lubricant or other fluid needed in the assembly of profiles of various sizes to create structural members dimensioned as needed (e.g., for the production of a concrete form).

Figure 11A:
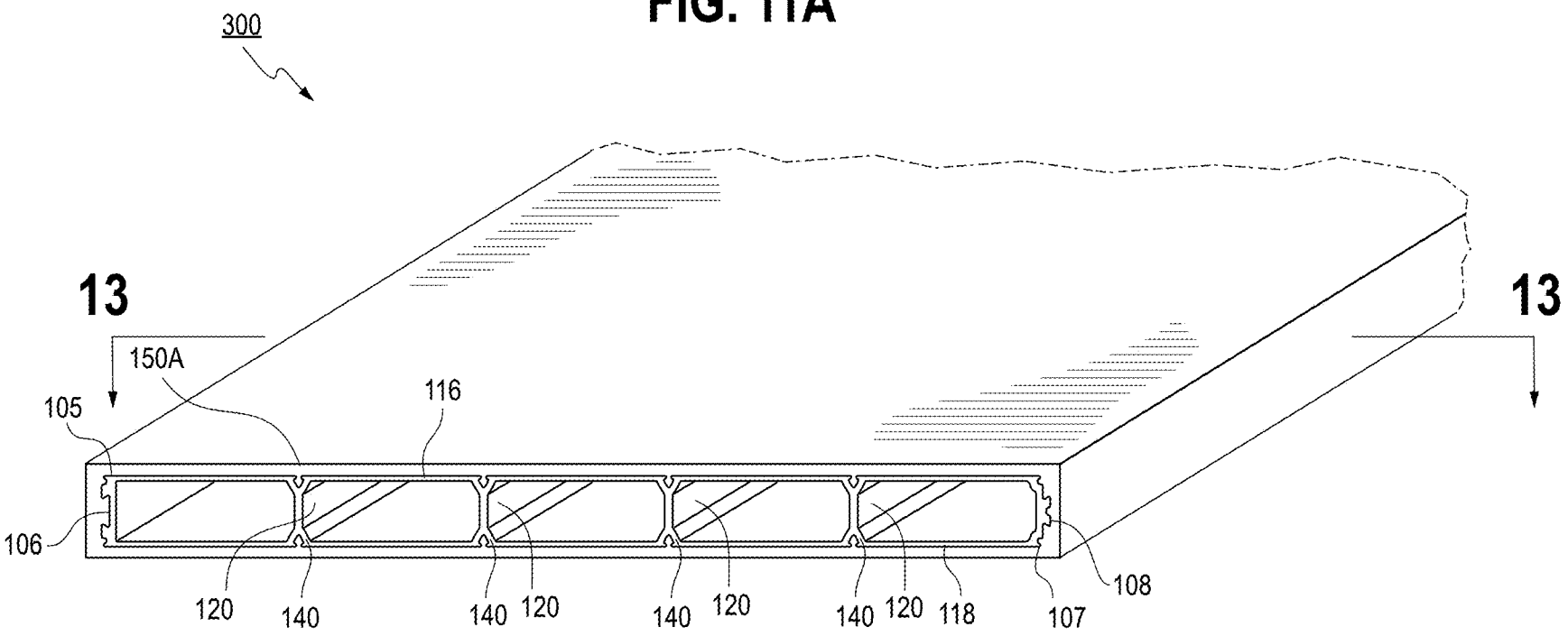
FIG. 11A is a top-down perspective view of one example of a structural member constructed in accordance with the teachings of the present disclosure, including the structural profile of the example shown in FIG. 1 and two interfacial layers attached thereto.
Figure 11B:
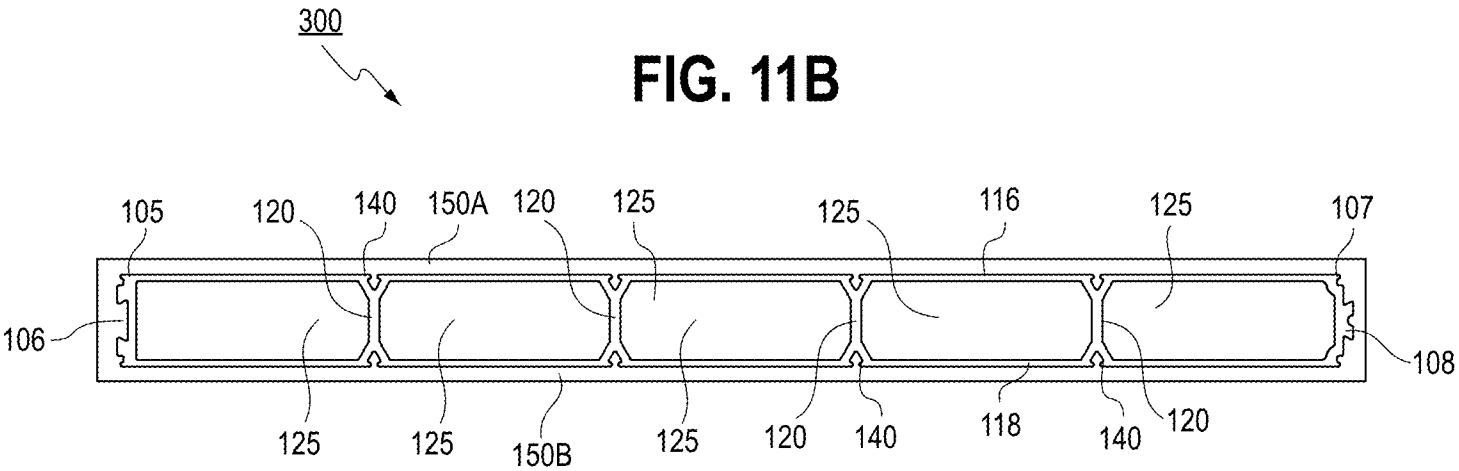
FIG. 11B is a cross-sectional view of the structural member of the example of FIG. 11A taken along the line EE.

FIGS. 11A and 11B show one example of a structural member 300 that is constructed in accordance with the teachings of the present disclosure and, as such, can be used for casting concrete. The structural member 300 generally includes the structural profile 101 and one or more interfacial layers attached thereto. In this example, the structural member 300 includes a first interfacial layer 150A and a second interfacial layer 150B attached to the first side 116 and the second side 118, respectively, of the structural profile 101. While the structural profile 101 shown in FIG. 1 is included in the structural member 300 in FIGS. 11A and 11B, the structural member 300 can instead include the structural profile 801 shown in FIG. 8. The first and second interfacial layers 150A, 150B are uninterrupted layers of material that surround the structural profile 101, forming a modular structural member 300. As illustrated and as will be discussed in greater detail below, during manufacture of the structural member 300, some of the material of the interfacial layers 150A, 150B flows into, or infiltrates, the fasteners 140 as well as some of the areas surrounding the dovetail joint 370. Further details about the interfacial layers 150A, 150B will be discussed in greater detail below.

Figure 12:
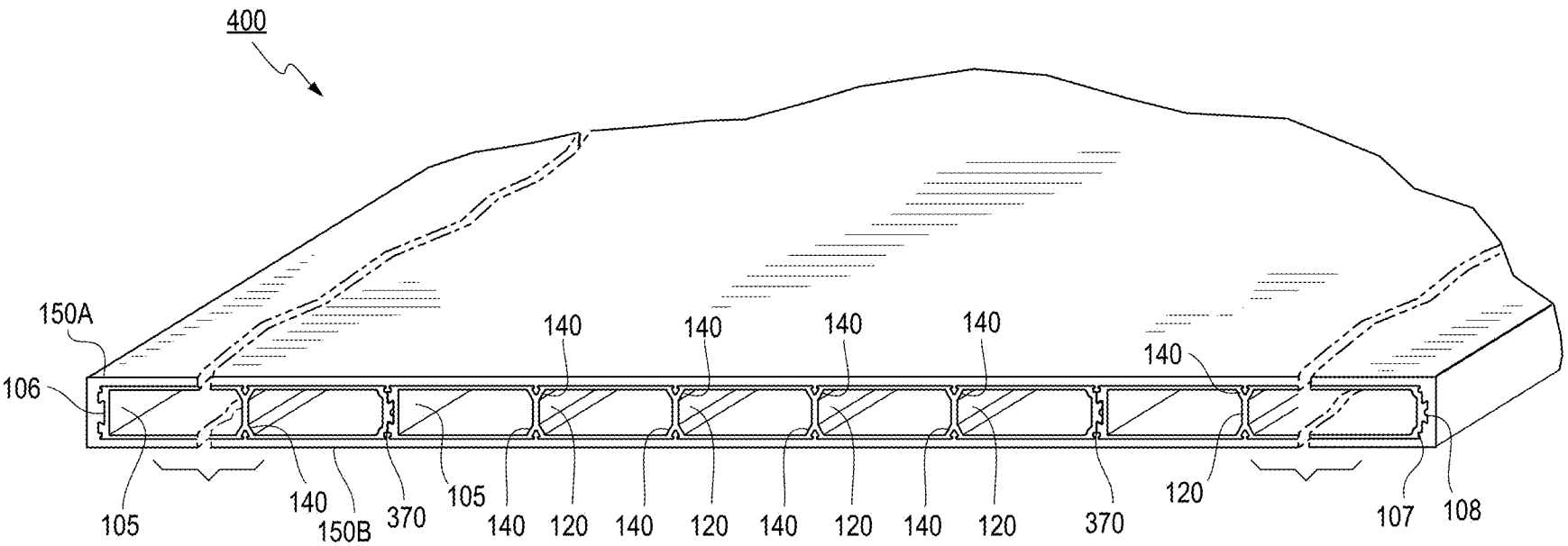
FIG. 12 is a perspective view of another example of a structural member that is constructed in accordance with the teachings of the present disclosure, including two structural profiles in accordance with the example shown in FIG. 1 connected by a dovetail joint.

FIG. 12 shows another example of a structural member 400 that is constructed in accordance with the teachings of the present disclosure and, as such, can be used for casting concrete. The structural member 400 includes two identical structural profiles 101 joined together by a dovetail joint 370 and then encapsulated by the interfacial layers 150A, 150B. The dovetail joint 370 is defined by the tongue 108 of one of the two structural profiles 101 being inserted or disposed into the groove 106 of the other of the two structural profiles 101.

Figure 13:
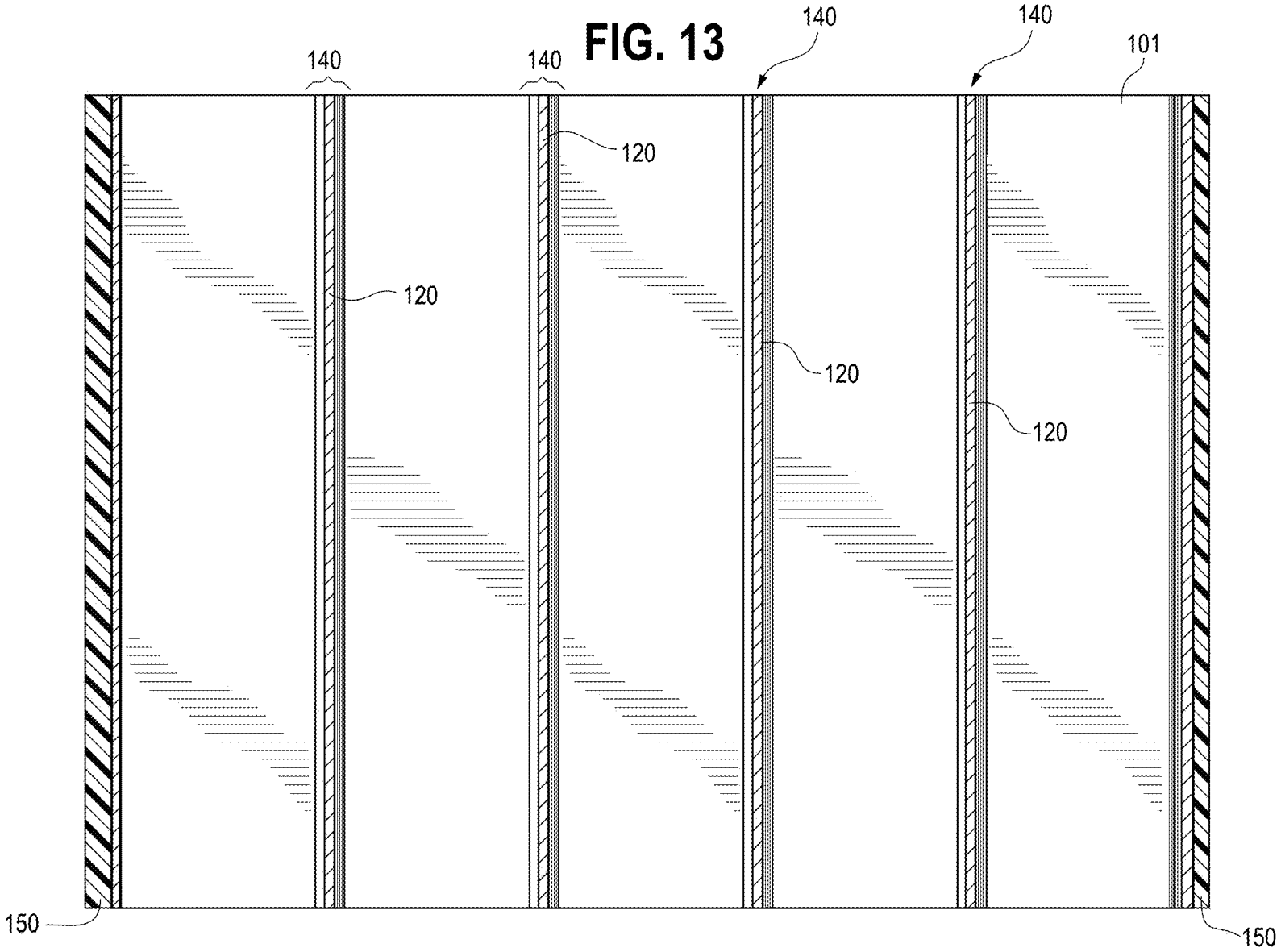
FIG. 13 is a top-down cross-sectional view of the structural member of FIG. 12.

FIG. 13 is a top-down cross-sectional view of the structural member 300 of FIG. 12, taken along the line FF. In this view, multiple structural profiles 101 can be seen with an interfacial layer 150.

Figure 14:
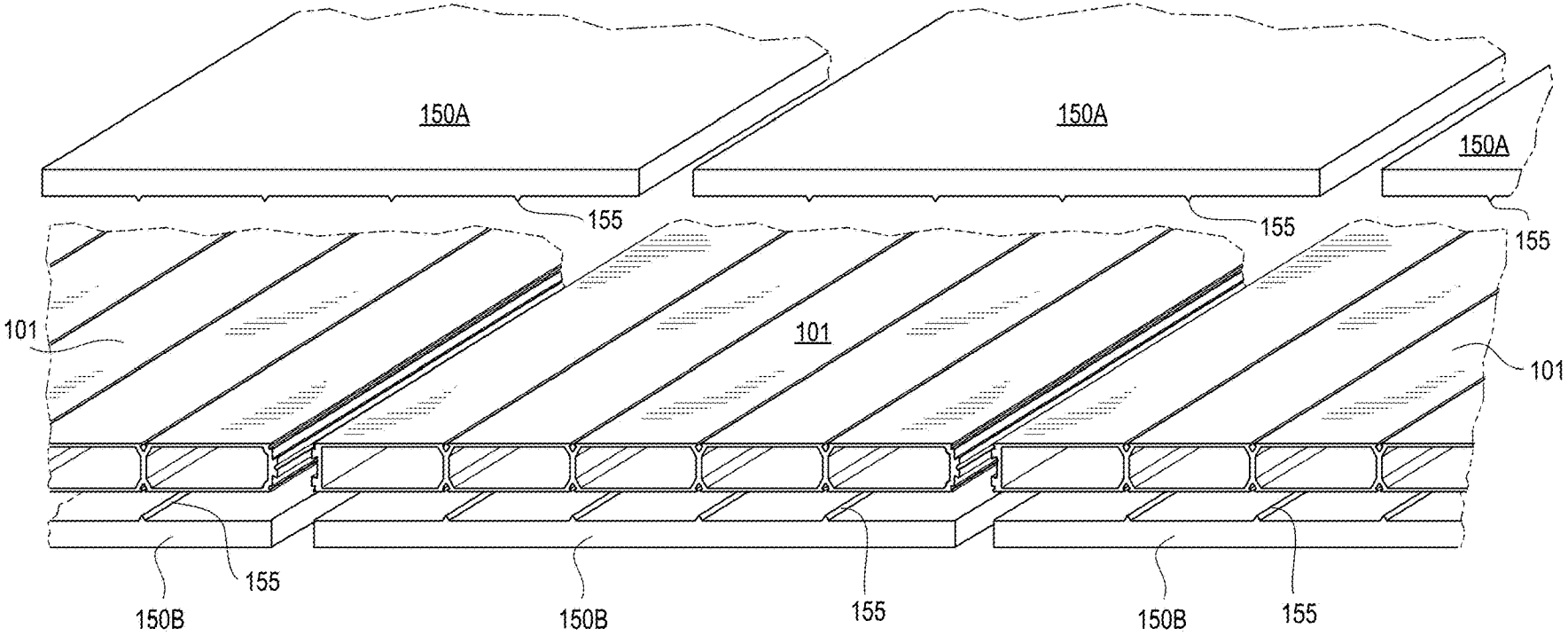
FIG. 14 is an exploded view of with the structural member of the example of FIG. 11A.

FIG. 14 is an exploded view of the structural member 300 which displays the interfacial layers 150A, 150B and multiple structural profiles 101. It can be seen that the interfacial layers 150A, 150B include portions which 155 extend from the bulk of each layer into the recesses 142 of fasteners 140. The interfacial layers 150A, 150B are shown as discontinuous, but the layers may be fabricated as a complete sheet and then attached to the corresponding side of the joined profiles 101 or the layers may form a complete sheet after attachment to the corresponding side of the joined profiles 101 and when in use. FIG. 12, for example, illustrates the interfacial layers 150A, 150B are continuous layers on either side of the joined profiles 101.

The structural profiles described herein (e.g., the structural profiles 101, 801) are made of a suitably strong and lightweight material. The structural profiles described herein are preferably made of aluminum (e.g., a recycled aluminum). However, the structural profiles can instead be made of aluminum alloys, steel alloys, polymer composites that include glass or other fibers surrounded by polymers, or ceramics with suitable toughness. The structural profiles described herein are preferably made using extrusion, yielding extruded structural profiles. However, the structural profiles may be made using a different technique (e.g., injection molding, casting, additive manufacturing (e.g., 3D printing), and machining). By manufacturing the structural profiles using extrusion, for example, the length L and the thickness T of the structural profiles can be quickly and easily adjusted to satisfy end use requirements.

The structural profiles may, for example, have a width in the range of around 2.00 inches (5.08 cm) to around 40 inches (101.60 cm), such as around 2.25 inches (5.715 cm) to around 37.50 inches (95.25 cm), such as from around 2.50 inches (6.35 cm) to around 35.00 inches (88.90 cm), around 2.75 inches (6.985 cm) to around 32.50 inches (82.55 cm), around 3.00 inches (7.62 cm) to around 30.00 inches (76.20 cm), such as between around 4.00 inches (10.16 cm) and around 20.00 inches (50.80 cm), such as between around 5.00 inches (12.70 cm) and around 10 inches (25.40 cm), including around 5.75 inches (14.605 cm).

The thickness of the structural profile may, for example, be in the range of around 0.200 inches (0.508 cm) to around 10 inches (22.400 cm), such as from around 0.250 inches (0.635 cm) to around 8.000 inches (20.320 cm), around 0.300 inches (0.762 cm) to around 7.000 inches (17.780 cm), such as from around 0.350 inches (0.889 cm) to around 06.000 inches (15.240 cm), including from around 0.400 inches (1.016 cm) to around 5.000 inches (12.700 cm). The first side and the second side may have a thickness ranging from around 0.020 inches (0.0508 cm) to around 0.40 inches (1.016 cm), such as from around 0.025 inches (0.0635 cm) to around 0.2 inches (0.508 cm), including from around 0.02 inches (0.0508 cm) to around 0.10 inches (0.254 cm).

The support beams may have a thickness ranging from around 0.010 inches (0.0254 cm) to around 0.500 inches (1.270 cm), such as from around 0.025 inches (0.0635 cm) to around 0.250 inches (0.635 cm), such as from around 0.020 inches (0.0508 cm) to 0.100 inches (0.254 cm).

The pitch between support beams may range from around 0.200 inches (0.508 cm) to around 6.500 inches (16.510 cm), such as around 0.250 inches (0.635 cm) to around 6.000 inches (15.240 cm), from around 0.500 inches (1.270 cm) to around 5.000 inches (12.700 cm), including from around 1.000 inches (2.540 cm) to around 4.000 inches (10.16), such as from around 1.100 inches (2.794 cm) to around 3.25 inches (8.255 cm), including from around 1.050 inches (2.667 cm) to around 3.000 inches (7.620 cm).

The interfacial layers described herein are configured to withstand harsh environments and abusive use, such as contact with poured and curing concrete when the structural members including those interfacial layers are in use as a concrete form. In order for the structural members to be reusable a significant number of times, the interfacial layers must be able to endure extreme pH and elevated temperatures, such as the harsh environments created during concrete curing and poured concrete while still being able to release from cured concrete without loss of its integrity. Weight is also a consideration with the interfacial layers. For example, utilizing heavier interfacial layers may strengthen the resulting structural member but will also decrease the portability and useability of that structural member. To meet all of these requirements, the interfacial layer should be resistant to at least alkaline pH conditions, elevated temperature, embrittlement for UV or temperature exposure, water or other liquid absorption, and abrasion by sand and aggregate (e.g., stones or rocks in the concrete mixture). The interfacial layer may also have a surface roughness (or smoothness) which allows for easy release of cured concrete from a form constructed of structural members. Alternatively, or additionally, the interfacial layer may have a layer of non-stick material, such as a polyfluorene material, or a smooth and glassy material, which can decrease the likelihood of adhesion between the cured concrete and the structural member.

The interfacial layer(s) are preferably molded to the structural profile(s) using a molding apparatus. In some implementations, the interfacial layer(s) may be injection molded around the structural profile(s) using an injection molding apparatus. In some implementations, the interfacial layer(s) may be compression molded or vacuum molded to the structural profile(s). The interfacial layer(s) may be applied in a co-extrusion process or in a process using heated rollers or plates to allow the material of the interfacial layer(s) to conform to the outer portion of the structural profile(s). Further, portions of the interfacial layer(s) may be applied to the structural profile(s) using injection molding and other portions may be applied using compression molding (e.g., low-pressure compression molding), water pressure molding, vacuum molding, spraying, electrostatic deposition, dip coating, or other suitable methods. The structural profile(s) may be annealed after the interfacial layer(s) are applied. The annealing process may enhance bonding between the profile(s) and interfacial layer(s) as well as strengthen the overall structural member.

The materials used to form the interfacial layer(s) may include polymers, polymer composites, composites with recycled reinforcing materials (e.g., recycled glass fiber, recycled ceramic inclusions in a matrix of recycled metal), metal foils or sheets, and other materials which satisfy the criteria described above. Plastic used for interfacial layers may include any of the following, alone or in combination: PP (polypropylene), PTFE (polytetrafluoroethylene), PEEK (polyether ether ketone), PEI (polyetherimide), PAI (polyamide-imide), PBI (polybenzimidazole), PET (polyethylene terephthalate), PVC (polyvinylchloride), and the like. In some embodiments, the polymers, the composite materials, the reinforcing material, and/or the metal foils or sheets may be recycled materials. The interfacial layer(s) may alternatively or additionally include composites with virgin polymers and/or virgin reinforcing materials.

Figure 15:
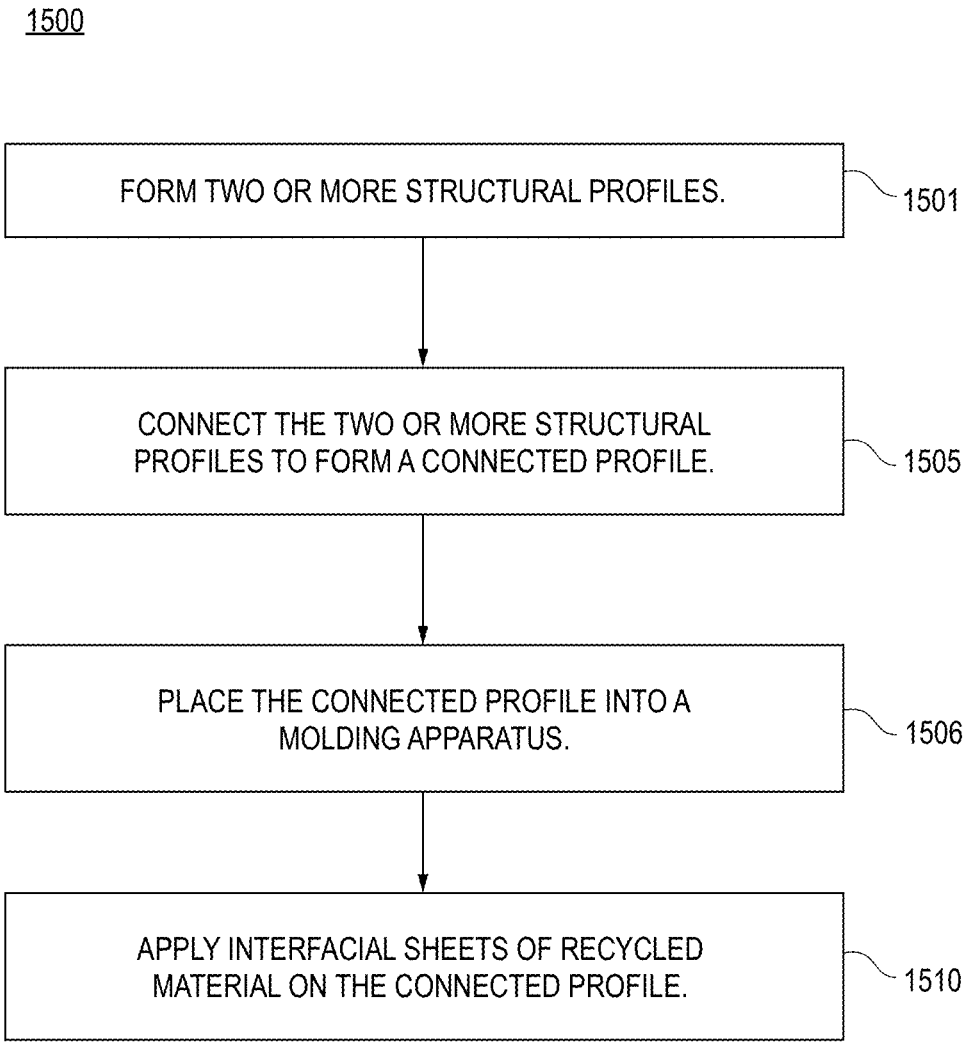
FIG. 15 is a schematic diagram of one example of a method for making a structural member for forming concrete.

Various methods can be used to form a structural member (e.g., the structural member 300, the structural member 400) in accordance with the teachings of the present disclosure. One example of a method 1500 of fabrication is shown in FIG. 15. The method 1500 begins with the formation of one or more structural profiles (e.g., structural profiles 101, 801) in step 1501. When the structural member includes two or more structural profiles, the two or more structural profiles are connected (e.g., using the dovetail joint 370) to form a connected profile in step 1505. The next step 1506 is placing the profile into a molding apparatus (e.g., an injection molding apparatus, a compression molding apparatus). The interfacial layers, which in this example are made of recycled material, are applied to the profile via the molding apparatus, as in step 1510. The result is a structural member that is lightweight, strong, and reusable.

Figure 16:
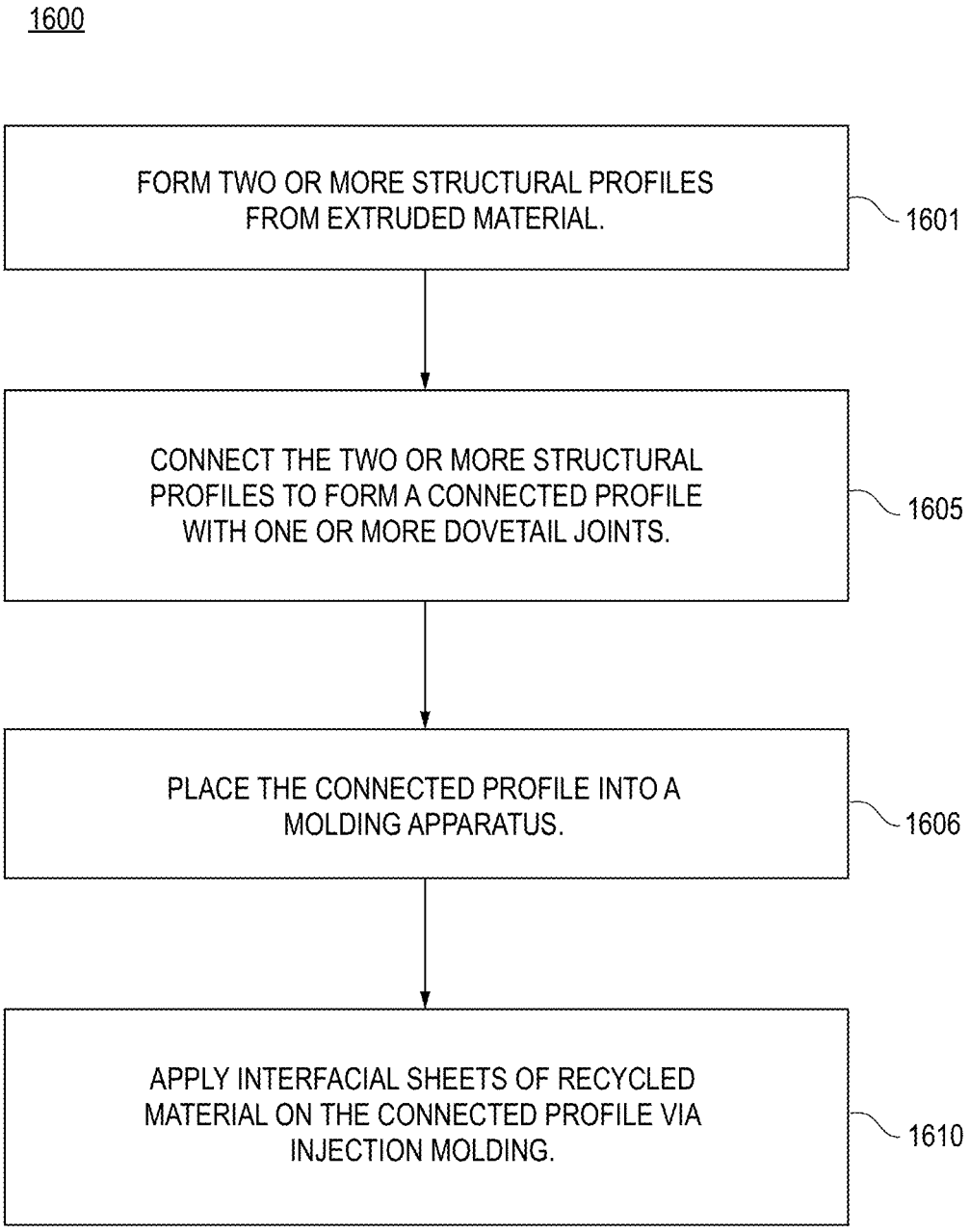
FIG. 16 is a schematic diagram of another example of a method for making a structural member for forming concrete.
Figure 17:
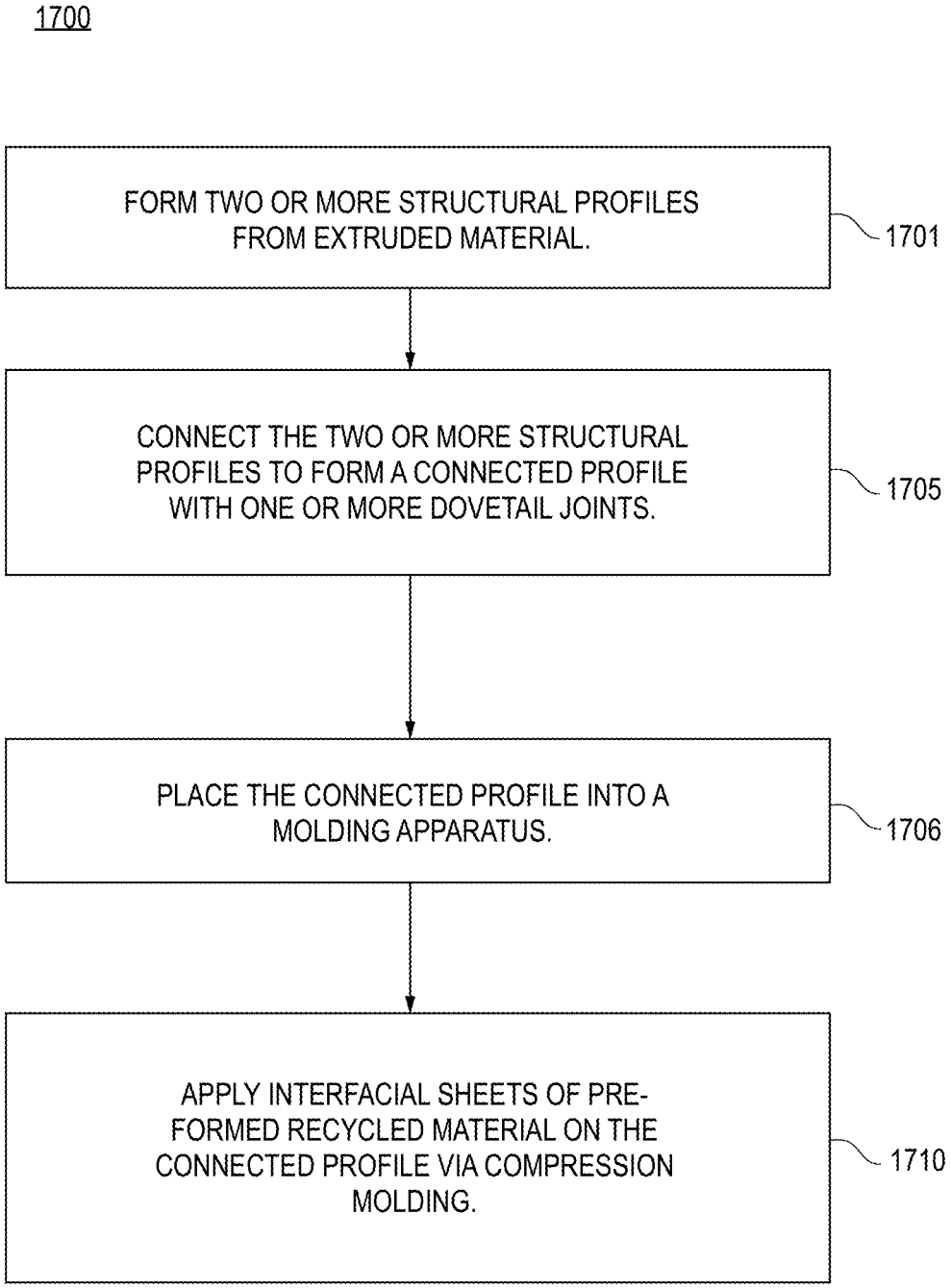
FIG. 17 is a schematic diagram of another example of a method for making a structural member for forming concrete.

Other examples of methods 1600, 1700 for forming a structural member (e.g., the structural member 300, the structural member 400) are shown in FIG. 16 and FIG. 17. One or more structural profiles are first created, preferably by extrusion, in the first step 1601, 1701. When the structural member includes two or more structural profiles, the second step 1605, 1705 includes connecting the two or more structural profiles with one or more dovetail joints to form a connected profile. The next step 1606, 1706 includes placing the profile into a molding apparatus. In the method 1600 shown in FIG. 16 interfacial layers of recycled polymer material (e.g., recycled plastic) are applied to the profile via injection molding in step 1610. Conversely, in the method 1700 shown in FIG. 17 interfacial layers of preformed recycled polymer material are applied on the profile using compression molding in step 1710. Alternatively, as indicated herein above, the interfacial layers may be formed of various types of materials and thus applied using techniques in addition to or different from injection molding and compression molding.

The structural members described herein may include any number of structural profiles coupled together, such that the structural members can have any number of different widths. The flexibility in the number of structural profiles, as well as the dimensions and shape of the profiles and overall structural members, facilitates customization as needed for a variety of configurations of concrete forms, and thus of concrete structures. These concrete structures may include curved structures. Furthermore, the lightweight nature of the structural members allows for facile construction of concrete forms in situ, e.g., at a job site, for even very tall concrete structures. At the same time, the robust nature of the structural members allows for the construction of concrete forms in most environments, such as in water, in cold environments, in areas susceptible to mold, rot, and mildew.

In some examples, multiple structural members may be connected via one or more dovetail joints which are created through a tongue slotting into a groove, preferably before attachment of the interfacial layer(s) but in some cases even after structural profiles are surrounded by interfacial layers. Joining structural members of various widths or varying configurations of joints and grooves may allow for curved or undulating forms.

The tongues 108, 808 shown in the examples above are two of many configurations for a tongue for use with the structural profiles presented herein. These tongues 108, 808 and their corresponding grooves connect two profiles of similar configuration to form a substantially flat or straight combined profile. Alternatively, or additionally, tongues may be used with corresponding grooves that allow for connection between adjacent structural profiles such that the combined profile has a curve or bend. The design of the tongues and grooves may be tailored for a variety of configurations, including differing radii of curvature, changing lengths, changing widths, and the like.

In use, to create a mold for concrete structure forming, two structural members may be joined together. The structural members may be connected via one or more fittings to define a trough, a slot, a hollow cylinder, a rectangular prism, or other volume into which liquid concrete flows before setting. The fittings may include a plurality of elongated components such as a bar, rod, or stake which pierces a first structural member, extends through the volume intended for liquid concrete, then pierces through a second structural member. Additionally, the fittings may include nuts or other securing components which attach to the elongated components in a removeable fashion, on the external faces of the structural member assembly.

To reuse the structural member(s), once the concrete has cured, the removable securing fittings (e.g., nuts) are separated from the structural members, then the structural members are dismounted from the elongated components and used to create another volume intended to receive liquid concrete. In this way, an on-site construction crew may utilize the structural member(s) to systematically build a structure with concrete foundations, walls, floors, and other elements. The structural member(s) may be assembled into a casting form before being delivered to a work site. Additionally, precast concrete elements may be created off-site in an efficient manner because the form may be reusable and so less time may be needed to create forms for common elements (e.g., conduits, reinforced concrete pipe, benches, slabs, planks, retaining walls, beams, columns, etc.) which are produced in bulk.

In addition to using structural members to create concrete forms, the structural profiles and structural members described herein may be used for other construction purposes. In the manufacture of buildings, storage facilities, gazebos, and other structures, the structural members may be used as paneling, decking, insulation, noise buffering panels, decorative facia, temporary walls, moveable walls, fencing, and the like. The structural members may be used to construct parts of vehicles, such as automobiles, boats, ships, kayaks, canoes, skate boards, surf boards, paddle boards, air gliders, unmanned aircraft (e.g., drones, UAV), and the like. The uses provided herein are examples, and other uses for structural members and structural profiles, in both decorative and structural endeavors, are possible.

Beneficially, the reusable and durable structural members and the concrete forms created with those structural members have a low carbon footprint and are versatile in configuration. While two configurations for the structural profile have been shown and described herein, it should be appreciated that these configurations are examples and that features including the fasteners, the tongue, and the slot may not be limited by their functionality in their design. Further, various configurations of a structural member may include surface decoration or designs imprinted or built up on the surface of interfacial layers.

The structural members described herein may exhibit materials properties on par with or exceeding that of plywood of similar dimensions. Properties may include any or all of: lateral force resistance, failure bending stress, buckling stiffness factor, failure compression, failure shear, modulus of elasticity, change in moisture content, stability, and number of repeated uses. The structural members may additionally be tested for performance under various conditions including any or all of: at high temperatures (e.g., temperatures over 100.0 deg. F (37.8 deg. C)), at low temperatures, under different durations of loading, under different conditions (e.g., wind, earthquake, impact), under varying anticipated dead load (constant load due to e.g., the mass of the concrete and the form), under varying anticipated live load (dynamic load due to e.g., worker movement), on varying configurations of support, and the like.

The following additional considerations apply to the foregoing discussion. Throughout this specification, plural instances may implement functions, components, operations, or structures described as a single instance. Although individual functions and instructions of one or more methods are illustrated and described as separate operations, one or more of the individual operations may be performed concurrently, and nothing requires that the operations be performed in the order illustrated. Structures and functionality presented as separate components in exemplary configurations may be implemented as a combined structure or component. Similarly, structures and functionality presented as a single component may be implemented as separate components. These and other variations, modifications, additions, and improvements fall within the scope of the subject matter herein.

As used herein any reference to "some examples" or "one example" or "an example" means that a particular element, feature, structure, or characteristic described in connection with the example is included in at least one example. The appearances of the phrase "in one example" in various places in the specification are not necessarily all referring to the same example.

Some examples may be described using the expression "coupled" and "connected" along with their derivatives. For example, some examples may be described using the term "coupled" to indicate that two or more elements are in direct physical or electrical contact. The term "coupled," however, may also mean that two or more elements are not in direct contact with each other, but yet still co-operate or interact with each other. The examples are not limited in this context.

As used herein, the terms "comprises," "comprising," "includes," "including," "has," "having" or any other variation thereof, are intended to cover a non-exclusive inclusion. For example, a function, process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the examples herein. This is done merely for convenience and to give a general sense of the description. This description should be read to include one or at least one and the singular also includes the plural unless it is obvious that it is meant otherwise.

Upon reading this disclosure, those of skill in the art will appreciate still additional alternative structural and functional designs for methods and systems for producing a reusable structural member through the disclosed principles herein. Thus, while particular examples and applications have been illustrated and described, it is to be understood that the disclosed examples are not limited to the precise construction and components disclosed herein. Various modifications, changes, and variations, which will be apparent to those skilled in the art, may be made in the arrangement, operation and details of the method and apparatus disclosed herein without departing from the spirit and scope defined in the appended claims.

The following list of aspects reflects a variety of the examples explicitly contemplated by the present application. Those of ordinary skill in the art will readily appreciate that the aspects below are neither limiting of the examples disclosed herein, nor exhaustive of all the examples conceivable from the disclosure above but are instead meant to be exemplary in nature.

1. A reusable structural member, the reusable structural member comprising:

a structural profile having:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side; and a fastener disposed at a first end of each of the plurality of support beams;

an interfacial layer; and a groove disposed along the first edge and a tongue disposed along the second edge of the structural profile, the tongue configured to be disposed in a groove of a second reusable structural profile to join the reusable structural profile and the second reusable structural profile together, and the groove configured to receive a tongue of a third reusable structural profile to join the reusable structural profile and the third reusable structural profile together, wherein the fasteners help secure the interfacial layer to the structural profile, and wherein at least one of the support beams and the interfacial layer comprises recycled material.

2. The reusable structural member of aspect 1, wherein the interfacial layer is configured to contact concrete while concrete is poured and sets.

3. The reusable structural member of aspect 2, wherein the interfacial layer is resistant to:

alkaline pH conditions;

elevated temperatures;

water or other liquid absorption; and abrasion by any of sand and aggregate.

4. The reusable structural member of aspect 1, wherein the recycled material comprises recycled plastic.

5. The reusable structural member of aspect 4, wherein the recycled plastic includes any of: PP (polypropylene), PTFE (polytetrafluoroethylene), PEEK (polyether ether ketone), PEI (polyetherimide), PAI (polyamide-imide), PBI (polybenzimidazole), PET (polyethylene terephthalate), PVC (polyvinylchloride), and any combination thereof.

6. The reusable structural member of aspect 4, wherein the interfacial layer further comprises a layer of composite material comprising a recycled polymer, a recycled glass component, or both a recycled polymer and a recycled glass component.

7. The reusable structural member of aspect 1, further comprising one or more open volumes, each of the one or more open volumes bounded by the first side or the second side, and at least one of the plurality of support beams.

8. The reusable structural member of aspect 7, further comprising a filler disposed in the one or more open volumes, the filler comprising any of:

a foamed material;

a hexagonal cell material;

a corrugated cardboard; and a sprayed-in expanding material.

9. An extruded structural profile for casting concrete, comprising:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side;

a fastener disposed at a first end of each of the plurality of support beams, the fastener adapted to help secure an interfacial layer to the extruded structural profile; and a groove disposed along the first edge and a tongue disposed along the second edge, the tongue configured to be disposed in a groove of a second extruded structural profile to join the extruded structural profile and the second extruded structural profile together, and the groove configured to receive a tongue of a third extruded structural profile to join the extruded structural profile and the third extruded structural profile together.

10. The extruded structural profile of aspect 9, wherein the extruded structural profile is formed of a recycled metal.

11. The extruded structural profile of aspect 10, wherein the recycled metal is recycled aluminum.

12. The extruded structural profile of aspect 9, wherein each of the fasteners is a female fastener that includes a recess into a corresponding support beam of the plurality of support beams.

13. The extruded structural profile of aspect 12, wherein each female fastener includes a narrowed neck at an opening of the respective recess.

14. The extruded structural profile of aspect 12, wherein the recess has a substantially triangular shape with an apex oriented toward a middle portion of the extruded structural profile and a base situated adjacent to either the first or second side.

15. The extruded structural profile of aspect 9, wherein each fastener includes a protrusion extending from a corresponding support beam of the plurality of support beams, the protrusion extending beyond the first or second side of the structural profile.

16. A method for making a reusable modular structural member for casting concrete, the method comprising:

forming first and second structural profiles, each structural profile having:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side;

a fastener disposed at a first end of each of the plurality of support beams; and a groove disposed along the first edge and a tongue disposed along the second edge of the reusable structural member;

connecting the first and second structural profiles by disposing the tongue of the first structural profile in the groove of the second structural profile, thereby forming a connected structure; and applying an interfacial layer on the connected structure, wherein at least one of the support beams and the interfacial layer comprises recycled material.

17. The method of aspect 16, wherein forming the first and second structural members comprises extruding the first and second structural members using aluminum.

18. The method of aspect 17, wherein applying the interfacial layer of recycled material comprises molding a polymer material to external portions of the connected structure.

19. The method of aspect 18, further comprising flowing the polymer material into the fastener, the fastener comprising:

a recess in a corresponding support beam of the plurality of support beams; or a protrusion extending from a corresponding support beam of the plurality of support beams away from a middle portion of the connected structure.

20. The method of aspect 16, further comprising inserting a filler into one or more open volumes in the structural member, the one or more open volumes each bounded by the first side and the second side of the first or second structural profile and at least one of the plurality of support beams, wherein the filler comprises any of:

a foamed material;

a hexagonal cell material;

a corrugated cardboard; and a sprayed-in expanding material.

21. A system for shaping a cast concrete structure, the system comprising:

a first reusable structural member according to aspect 1; and a second reusable structural member having a similar configuration to that of the first reusable structural profile, wherein the first reusable structural member and the second reusable structural member are removably joined along edges having grooves and tongues, such that the joined edges form a dove tail joint.

22. The system according to aspect 21, further comprising fittings which secure a third reusable panel in a fixed position relative to the first and second reusable panels.

What is claimed is:

1. A reusable structural member, the reusable structural member comprising:

a structural profile formed of metal and having:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side; and a fastener disposed at a first end of each of the plurality of support beams;

an interfacial layer; and a groove disposed along the first edge and a tongue disposed along the second edge of the structural profile, the tongue configured to be disposed in a groove of a second reusable structural profile to join the reusable structural profile and the second reusable structural profile together, and the groove configured to receive a tongue of a third reusable structural profile to join the reusable structural profile and the third reusable structural profile together, wherein the fasteners help secure the interfacial layer to the structural profile, and wherein at least one of the structural profile and the interfacial layer comprises recycled material.

2. The reusable structural member of claim 1, wherein the interfacial layer is configured to contact concrete while concrete is poured and sets.

3. The reusable structural member of claim 2, wherein the interfacial layer is resistant to:

alkaline pH conditions;

elevated temperatures;

water or other liquid absorption; and abrasion by any of sand and aggregate.

4. The reusable structural member of claim 1, wherein the recycled material comprises recycled plastic.

5. The reusable structural member of claim 4, wherein the recycled plastic includes any of: PP (polypropylene), PTFE (polytetrafluoroethylene), PEEK (polyether ether ketone), PEI (polyetherimide), PAI (polyamide-imide), PBI (polybenzimidazole), PET (polyethylene terephthalate), PVC (polyvinylchloride), and any combination thereof.

6. The reusable structural member of claim 4, wherein the interfacial layer further comprises a layer of composite material comprising a recycled polymer, a recycled glass component, or both a recycled polymer and a recycled glass component.

7. The reusable structural member of claim 1, further comprising one or more open volumes, each of the one or more open volumes bounded by the first side or the second side, and at least one of the plurality of support beams.

8. The reusable structural member of claim 7, further comprising a filler disposed in the one or more open volumes, the filler comprising any of:

a foamed material;

a hexagonal cell material;

a corrugated cardboard; and a sprayed-in expanding material.

9. An extruded structural profile for casting concrete, comprising:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side;

a fastener disposed at a first end of each of the plurality of support beams, the fastener adapted to help secure an interfacial layer to the extruded structural profile; and a groove disposed along the first edge and a tongue disposed along the second edge, the tongue configured to be disposed in a groove of a second extruded structural profile to join the extruded structural profile and the second extruded structural profile together, and the groove configured to receive a tongue of a third extruded structural profile to join the extruded structural profile and the third extruded structural profile together;

wherein each of the fasteners is a female fastener that is formed in either the first side or the second side and includes a recess into a corresponding support beam of the plurality of support beams.

10. The extruded structural profile of claim 9, wherein the extruded structural profile is formed of a recycled metal.

11. The extruded structural profile of claim 10, wherein the recycled metal is recycled aluminum.

12. The extruded structural profile of claim 9, wherein each female fastener further includes a narrowed neck at an opening of the respective recess.

13. The extruded structural profile of claim 9, wherein the recess has a substantially triangular shape with an apex oriented toward a middle portion of the extruded structural profile and a base situated adjacent to either the first or second side.

14. A method for making a reusable modular structural member for casting concrete, the method comprising:

forming first and second structural profiles, each structural profile formed of metal and having:

a length, a width, and a thickness;

a first side and a second side opposite the first side, the first and second sides defining the width and the length;

a first edge and a second edge opposite the first edge, each of the first and second edges extending between the first and second sides and defining the thickness;

a plurality of support beams, each support beam extending between the first side and the second side;

a fastener disposed at a first end of each of the plurality of support beams; and a groove disposed along the first edge and a tongue disposed along the second edge of the reusable structural member;

connecting the first and second structural profiles by disposing the tongue of the first structural profile in the groove of the second structural profile, thereby forming a connected structure; and applying an interfacial layer on the connected structure, wherein at least one of the support beams and the interfacial layer comprises recycled material.

15. The method of claim 14, wherein forming the first and second structural profiles comprises extruding the first and second structural profiles using aluminum.

16. The method of claim 14, wherein applying the interfacial layer of recycled material comprises molding a polymer material to external portions of the connected structure.

17. The method of claim 14, further comprising flowing the polymer material into the fastener, the fastener comprising:

a recess in a corresponding support beam of the plurality of support beams; or a protrusion extending from a corresponding support beam of the plurality of support beams away from a middle portion of the connected structure.

18. The method of claim 14, further comprising inserting a filler into one or more open volumes in the structural member, the one or more open volumes each bounded by the first side and the second side of the first or second structural profile and at least one of the plurality of support beams, wherein the filler comprises any of:

a foamed material;

a hexagonal cell material;

a corrugated cardboard; and a sprayed-in expanding material.

19. The reusable structural member of claim 1, wherein each fastener includes a protrusion extending from a corresponding support beam of the plurality of support beams, the protrusion extending beyond the first or second side of the structural profile.

20. The reusable structural member of claim 1, wherein each fastener is a female fastener that is formed in either the first side or the second side and includes a recess into a corresponding support beam of the plurality of support beams.

* * * * *